United States Patent [19]

Ling

[11] Patent Number: 4,515,855

[45] Date of Patent: May 7, 1985

[54] PROCESS FOR SIZING TEXTILE MATERIALS

[75] Inventor: Chi-Fei Ling, Edison, N.J.

[73] Assignee: American Cyanamid Company, Stamford, Conn.

[21] Appl. No.: 474,627

[22] Filed: Mar. 11, 1983

Related U.S. Application Data

[63] Continuation-in-part of Ser. No. 268,924, Jun. 1, 1981, abandoned.

[51] Int. Cl.[3] ..... B32B 27/00; B05D 3/02

[52] U.S. Cl. ..... 428/290; 252/8.8; 427/154; 427/155; 427/389.9; 427/392; 427/393.1; 428/378

[58] Field of Search ..... 252/8.8; 427/389.9, 427/392, 393.1, 154, 155; 526/307.7; 428/378, 290

[56] References Cited

U.S. PATENT DOCUMENTS

| | | | |
|---|---|---|---|
| 2,816,882 | 12/1957 | Schiller | 526/307.7 |
| 2,976,167 | 3/1961 | Maeder et al. | 427/389.9 X |
| 3,095,320 | 6/1963 | Leitner | 427/389.9 |
| 4,293,600 | 10/1981 | Fink et al. | 427/389.9 X |

FOREIGN PATENT DOCUMENTS

| | | | |
|---|---|---|---|
| 1195050 | 6/1965 | Fed. Rep. of Germany | 526/307.7 |
| 0962109 | 6/1964 | United Kingdom | 526/307.7 |

*Primary Examiner*—Thurman K. Page

*Attorney, Agent, or Firm*—Charles J. Fickey; Gordon L. Hart

[57] ABSTRACT

This invention is to a process for sizing textile materials by treatment with copolymers, and/or multipolymers, of acrylamide, the products thereby obtained and the sizing compositions used.

9 Claims, No Drawings

PROCESS FOR SIZING TEXTILE MATERIALS

This is a continuation-in-part of previously filed application Ser. No. 268,924, filed June 1, 1981, now abandoned.

The invention is a process for sizing textile materials by treatment of the materials with copolymers, and/or multipolymers, of acrylamide and at least one monomeric compound containing a hydrophobic polymerizable reactive vinyl, or vinylidene, group.

The use of homopolymers of acrylamide as sizing agents for warp yarns, to prevent breaking of the yarn during weaving, is wellknown. If performs only slightly better than starch, a commonly employed textile size that imparts only minor protection to fibers during weaving. The moderate performance of polyacrylamide and starch is due to the brittleness of their films on the fiber. Although copolymers of acrylamide and other vinyl, or vinylidene monomers have also been used as sizes for warp yarns, almost invariably the acrylamide they contain is a minor component of the copolymer. Consequently, such sizes are, therefore, often water-insoluble and difficult to desize.

The use of a copolymer of acrylamide and acrylic acid, containing a minor amount of acrylic acid monomer, as a sizing agent, is disclosed by Petrov et al. (see Chem. Abstracts 90:105488b). However, these sizes have two components that are both polar and hydrophilic, whereas the sizes of this invention involve at least one hydrophobic and less polar component that can alter the properties of the product such as lubricity, adhesion, and film flexibility. Polyacrylamide is water soluble but brittle. The addition of acrylic acid (neutralized) will soften the polymer, but levels of 15–20% are required to achieve this. The higher the amount of acrylic acid (neutralized) in the copolymer, the more moisture sensitive it becomes. This causes tacky films, which in turn causes weaving problems. If the acrylic acid is not neutralized, no softening of the polymer is achieved, and the copolymers are brittle. Moreover, the un-neutralized acrylic acid copolymers are acidic causing corrosion problems to the weaving equipment.

It is further known from Chem. Abstracts (CA77:127,977) to make copolymers containing relatively low acrylamide content and high alkyl acrylate content. However, these block copolymers (also the random copolymers) have no water solubility, especially after heat setting. They could not be readily removed from yarn following weaving. Moreover, the compositions are used as a laminate adhesive rather than as a warp size in the reference.

In general, the copolymers of the invention offer water solubility, softness, high abrasion resistance and removability following weaving. The prior art copolymers do not possess these properties, and do not suggest them or render them predictable. Moreover, the copolymers of the application may be recovered following removal from the yarn and reused.

Thus this invention offers the following advantages:

1. It imparts better yarn-to-yarn and yarn-to-metal abrasion resistance for yarns than starch, or polyacrylamide sizes.

2. It can be applied from more concentrated solutions than starch. This permits an application with less water, thus saving drying time and energy.

3. The pad baths are more easily prepared because of the high solubility of the size in water.

4. The application solutions are stable, and do not retrograde like those containing starch.

5. The polymeric sizing agent is readily removed from the textile substrate by rinsing with water.

6. The treated yarns do not have any dry splitting difficulty during slashing.

In preparing the solution to be applied in the copolymer process of this invention, acrylamide and about 1–40%, preferably about 5–20%, by weight of a hydrophobic polymerizable vinyl, or vinylidene monomer, or mixture of monomers, based on the weight of acrylamide, are copolymerized in an aqueous medium, under an inert atmosphere, in the presence of a surface-active agent and a catalytic amount of a free-radical source such as ammonium persulfate, ammonium persulfate and sodium bisulfite, and the like. The reaction mixture is stirred under the inert atmosphere until the copolymerization is essentially completed. The product is a semi-viscous solution that can be applied directly to the textile substrate. Optionally, starch or other sizes may be blended with the product, and other conventional additives, such as plasticizers, may be added to the solution before application. Suitable plasticizers include glycerol, ethanolamine, ethylene glycol, polyethylene glycol, urea, sugar, sorbitol, and the like.

Suitable hydrophobic vinyl and vinylidene comonomers include the following:

methyl acrylate,
ethyl acrylate,
n-butyl acrylate,
2-ethylhexyl acrylate,
2-hydroxyethyl acrylate,
2-methoxyethyl acrylate,
methyl methacrylate,
n-dodecyl methacrylate,
acrylonitrile,
vinyl acetate,
polybutadiene,
styrene
N-tert-butyl-2-aminoethyl methacrylate,
N,N-dimethyl-2-aminoethyl acrylate,
N,N-diethyl-2-aminoethyl methacrylate,
and the like.

The preferred hydrophobic comonomer is a $C_4$–$C_{18}$ alkyl acrylate or methacrylate.

Although acrylic acid and methacrylic acid are hydrophylic and thus are not suitable as comonomers to form a satisfactory copolymer for warp sizing purposes, these compounds can be used as an additional component in the copolymers of the present invention to vary the properties of the copolymer, for example to obtain an increase in adhesion when desired. The additional component should not, however, be added in an amount greater than about 20% by weight based on the weight of the acrylamide and acrylate components.

The application of the sizing composition to the textile material is by conventional padding, spraying, knife-coating, and the like, to deposit thereon about 3–15%, preferably about 6–8%, by weight real solids from the aforedescribed reaction mixture. Suitable textile materials include filaments, spun yarns, or fabrics of natural or synthetic fibers, or blends thereof. The preferred substrate material is cotton, or cotton/polyester warp yarn.

The treated textile substrate is then dried by heating at 120°–80° C. for a period of about 0.25 to 15 minutes, preferably at 105°–95° C. for a period of about 0.5 to 2 minutes. Optionally, the treated substrate may be dried at a lower temperature, such as by standing at room temperature until dry.

The process of this invention produces a size coating on the textile substrate which is characterized by easy removal by subsequent washing. The treated textile substrate is characterized by excellent abrasion resistance.

The following examples illustrate the process of the invention. All parts are by weight unless otherwise indicated.

EXAMPLE 1

A mixture of 30.9 grams of acrylamide (97% real), 3.0 grams of n-butyl acrylate, 0.3 gram of ammonium persulfate, 1.5 grams of a nonionic surfactant (DECERSO® Surfactant NI Conc.; American Cyanamid Co.), and 3.0 grams of isopropanol, is blended under nitrogen, and diluted with water to a total weight of 330 grams. The diluted mixture is heated to 70° C. to initiate polymerization. The heating is discontinued when the temperature reaches 85° C. The mixture is then stirred at 35°-40° C. for 2 hours and cooled to room temperature. The final solution has a viscosity of 1875 centipoises.

EXAMPLE 2

A mixture of 240 grams of an aqueous solution of acrylamide (50% real solids), 6.0 grams of 2-ethylhexyl acrylate, 0.3 gram of ammonium persulfate, 2.0 grams of DECERESOL® Surfactant NI Conc., 6.0 grams of isopropanol, and 473.7 grams of water is mixed under nitrogen, and heated to 70° C. The temperature is allowed to rise to 92° C. and then maintained at 85°-90° C. for one hour while stirring the reaction mixture. The mixture is then cooled to room temperature to obtain a solution having a viscosity of 640 centipoises.

EXAMPLE 3

A mixture of 240 grams of acrylamide (50% real), 6.0 grams of 2-ethylhexyl acrylate, 6.0 grams of methyl methacrylate, 0.3 gram of ammonium persulfate, 2.0 grams of DECERESOL® Surfactant NI Conc., 4.0 grams of isopropanol, and 527.7 grams of water is mixed under nitrogen, and heated to 70° C. The temperature is allowed to rise to 93° C. and then maintained at 87°-93° C. for 2 hours while stirring the reaction mixture. The mixture is then cooled to room temperature to obtain a solution having a viscosity of 600 centipoises.

EXAMPLE 4

A mixture of 152 grams of an aqueous solution of acrylamide (50% real solids), 4.0 grams of 2-ethylhexyl acrylate, 1.5 grams of AEROSOL® OT-75%, and 232.4 grams of water is stirred under nitrogen for 20 minutes at ambient temperature. Solutions of 0.3 gram of ammonium persulfate in 5 grams of water, and 0.3 gram of sodium bisulfite in 5 grams of water are added thereto and the temperature is allowed to rise spontaneously. The reaction mixture is stirred for one hour, then cooled to 25° C. to obtain a solution having a viscosity of 540 centipoises.

EXAMPLE 5

A mixture of 1.5 grams of AEROSOL® OT-75% and 237.3 grams of water is heated to dissolve the surfactant, then cooled to room temperature. The solution is stirred under nitrogen and 120 grams of an aqueous solution of acrylamide (50% real solids), 4.0 grams of 2-ethylhexyl acrylate, and 16.2 grams of acrylic acid are added thereto. Solutions of 0.5 gram of ammonium persulfate in 10 grams of water, and 0.5 gram of sodium metabisulfite in 10 grams of water, are added thereto while allowing the temperature to rise. After stirring for 1.5 hours, the reaction mixture is cooled to room temperature to obtain a solution having a viscosity of 620 centipoises, and a pH of 2.5. Before application the pH of the material is adjusted to 5-7 with sodium hydroxide.

EXAMPLES 6-12

The solutions from Examples 1-5 are diluted with water to obtain a solids content of 7.5% by weight and applied separately, by padding, to single-end 100% cotton yarns to obtain 80% wet pickup based on the weight of the untreated yarn. Solutions containing 7.5% by weight of polyacrylamide in water, and starch in water, are also prepared and applied to single-end 100% cotton yarns in a similar manner. The treated yarns are dried at 105° C. for one minute and tested for abrasion resistance using a modified Stoll flex abrader. In this test five strands of the treated yarns are attached to Stoll flex abrader so that all are flexed over a stainless steel blade at a 90° angle using an attached 20-gram weight as a pulling force. The motor is started and the number of cycles needed to break each yarn is determined. This procedure is repeated three times for similarly treated yarns and an average is taken. The larger the average, the better the abrasion resistance imparted to the yarn.

The results obtained are shown in Table I.

TABLE I

| Example | Sizing Agent | Average Abrasion Resistance (cycles) |
|---|---|---|
| 6 | Product of Example 1 | 105 |
| 7 | Product of Example 2 | 119 |
| 8 | Product of Example 3 | 113 |
| 9 | Product of Example 4 | 113 |
| 10 | Product of Example 5 | 106 |
| 11 | Polyacrylamide | 89 |
| 12 | Starch | 92 |
| | Untreated cotton yarn | 62 |

EXAMPLE 13

The following copolymer of acrylamide and acrylic acid was prepared.

56 grams 50% acrylamide, 12 grams acrylic acid and 127 grams water were mixed, and warmed up to 30° C. Nitrogen was used to purge the flask. Then 0.7 gram ammonium persulfate in 3 grams of water and 0.7 gram sodium metabisulfite in 3 grams water were added, respectively. After 20 minutes, the reaction began to take place, the temperature slowly rose to 78° C. (max.) after stirring for 1.5 hour a 20% copolymer was thus produced with an acrylamide/acrylic acid ratio of 70/30. 7 grams NaOH in 30 grams water was then added to neutralize the copolymer.

EXAMPLE 14

A film was cast by pouring about 10 grams of the copolymer liquid of Example 13 on a Plexiglass sheet and allowing it to dry overnight. The dried film was put in a conditioning room with moisture control. At 65% R.H. the film became tacky. At 80% R.H. which is a common humidity in textile mills, the film became extremely tacky. This example demonstrates that copolymer of acrylamide and acrylic acid would be unsuitable as a warp textile size since it would cause yarns to adhere to the spinning and other equipment.

I claim:

1. A process for sizing a textile substrate material comprising applying to the textile material a composition comprising an aqueous solution of at least 3% by weight solids content of a copolymer of acrylamide and at least one hydrophobic vinyl, or vinylidene, polymerizable monomer, the amount of the polymerizable monomer in the composition being at a concentration from about 1% to 40%, based on the weight of acrylamide in the composition, and thereafter drying the treated substrate, the composition being applied in an amount and the drying being at a temperature, respectively, sufficiently high to impart a high order of abrasion resistance to the textile material, the composition being capable of being removed from said textile substrate material by aqueous washing.

2. The process according to claim 1 wherein the composition comprises a solution in water of a copolymer of claim 1 at a concentration from about 5% to about 30% by weight of the copolymer, based on the weight of the composition, the composition being applied to the textile material to deposit the copolymer in an amount from about 3% to about 15% by weight based on the weight of the material, and drying the same at a temperature ranging from about 80° C. to about 120° C. for about 15–0.25 minutes.

3. The process according to claim 2 wherein the amount of copolymer deposited on the textile material is from about 6% to about 8% by weight based on the weight of the material, and drying the same at a temperature from about 95° C. to about 105° C. for about 2–0.5 minutes.

4. The process according to claim 1 wherein the textile material is a cotton yarn.

5. The process according to claim 1 wherein the textile material is a cotton/polyester yarn.

6. The process according to claim 1 wherein the textile material is a polyester yarn.

7. The process according to claim 1 wherein the vinyl polymerizable monomer is a $C_4$–$C_{18}$ alkyl acrylate, or a $C_4$–$C_{18}$ alkyl methacrylate.

8. The process according to claim 7 wherein the $C_4$–$C_{18}$ alkyl acrylate is 2-ethyhexyl acrylate.

9. The treated textile material of claim 4.

* * * * *